US005900725A

United States Patent [19]

Draxelmayr

[11] Patent Number: 5,900,725

[45] Date of Patent: May 4, 1999

[54] CIRCUIT ARRANGEMENT FOR CURRENT TRANSFORMATION

[75] Inventor: Dieter Draxelmayr, Villach, Austria

[73] Assignee: Siemens Aktiengesellschaft, Munich, Germany

[21] Appl. No.: 08/981,264

[22] PCT Filed: Jun. 27, 1996

[86] PCT No.: PCT/DE96/01148

§ 371 Date: Dec. 16, 1997

§ 102(e) Date: Dec. 16, 1997

[87] PCT Pub. No.: WO97/01810

PCT Pub. Date: Jan. 16, 1997

[30] Foreign Application Priority Data

Jun. 27, 1995 [DE] Germany ..... 195 23 329

[51] Int. Cl.[6] ..... G05F 3/26

[52] U.S. Cl. ..... 323/312; 323/315

[58] Field of Search ..... 323/312, 313, 323/315; 327/538, 530

[56] References Cited

U.S. PATENT DOCUMENTS

| | | | |
|---|---|---|---|
| 3,867,685 | 2/1975 | Ahmed . | |
| 4,147,971 | 4/1979 | Price | 323/315 |
| 5,164,658 | 11/1992 | Kuwahara . | |
| 5,241,227 | 8/1993 | Jung et al. | 307/520 |
| 5,357,188 | 10/1994 | Takeda et al. . | |
| 5,463,308 | 10/1995 | Vorenkamp et al. | 323/312 |
| 5,483,151 | 1/1996 | Yamashita | 323/312 |
| 5,514,950 | 5/1996 | Sevenhans et al. | 323/315 |
| 5,594,633 | 1/1997 | Asazawa | 363/73 |

FOREIGN PATENT DOCUMENTS

| | | |
|---|---|---|
| 0 419 819 | 3/1989 | European Pat. Off. . |
| 29 605 | 12/1987 | Germany . |

OTHER PUBLICATIONS

U. Tietze Ch. Schenk—Halbleiter–Schaltungstechnik 1985 3 pages.

*Primary Examiner*—Adolf Deneke Berhane
*Attorney, Agent, or Firm*—Hill & Simpson

[57] ABSTRACT

A circuit arrangement for current transformation contains four current branches with four transistors that are coupled in pairs at the emitter side, and that have control terminals cross-coupled in pairs. Of the pairs of transistors with common control terminals, one transistor is connected as a diode. The circuit arrangement is suited for the transformation of currents, and in particular for the production of a current with a predetermined temperature coefficient, without requiring a temperature-constant resistance.

11 Claims, 1 Drawing Sheet

CIRCUIT ARRANGEMENT FOR CURRENT TRANSFORMATION

BACKGROUND OF THE INVENTION

The invention relates to a circuit arrangement for current transformation with four current branches, containing a first, a second, a third and a fourth transistor, coupled in pairs.

Circuit arrangements for current transformation are known for example from the publication U. Tietze, Ch. Schenk: Halbleiter-Schaltungstechnik, Springer-Verlag, $7^{th}$ ed., 1985, pp. 364ff. A current mirror thereby functions as the simplest transformation circuit. It is often necessary to produce a current with particular characteristics that cannot be realized with the known circuit arrangements. Other circuit arrangements can be integrated only poorly, e.g. because they require resistances with particular characteristics, e.g. temperature-constant resistances.

In particular, circuit arrangements that produce an output current by means of multiplication or division of currents, or that are suited for temperature compensation or, for producing a predetermined temperature coefficient, can be integrated only with great expense and are little known.

SUMMARY OF THE INVENTION

It is an object of the invention to provide a circuit arrangement for current transformation that can be integrated and that is suited, in particular, for the production of a current with a predetermined temperature coefficient.

The invention solves object with the features of patent

According to the present invention, a circuit arrangement is provided for current transformation having four current branches containing a respective first, second, third and fourth transistor. The transistors are coupled in pairs such that terminals of charge carrying sources of the first and fourth transistors are connected with the first node point, and terminals of charge carrying sources of the second and third transistors are connected with the second node point. A control terminal and a terminal of the charge carrying drain of the second and of the third transistors are connected with one another. The control terminals of the first and the second transistors are connected with one another and control terminals of the third and fourth transistors are connected with one another.

The invention has the advantage that it is suited both for the production of a current by means of multiplication or division of single currents and also as a circuit for temperature compensation or for the production of a predetermined temperature coefficient. For example, the circuit arrangement is suited for the production of a current that is proportional to the absolute temperature, without requiring a temperature constant resistance. In the same way, an output current with a linear temperature coefficient can be produced from a given parent current.

The invention is explained in more detail on the basis of two exemplary embodiments shown in the figures in the drawings.

DESCRIPTION OF THE PREFERRED EMBODIMENTS

Figure 1:
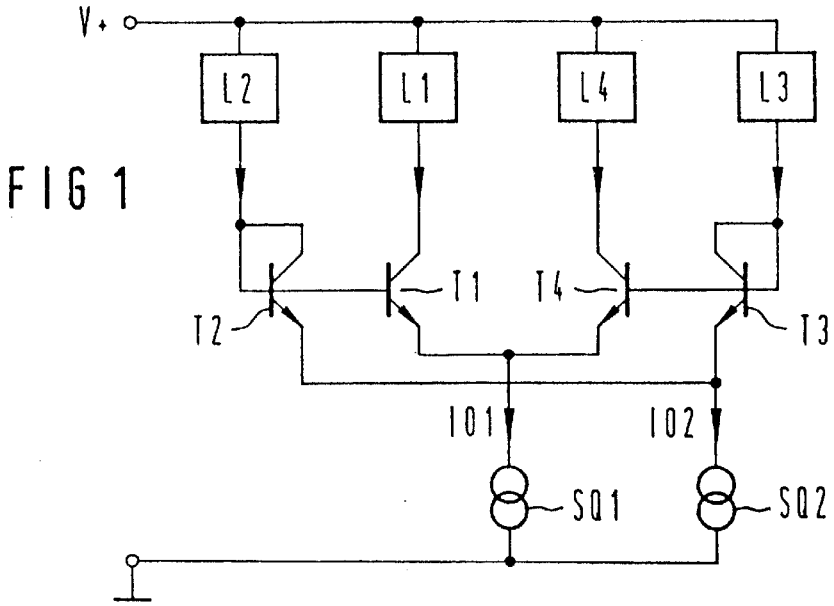
FIG. 1 shows a first exemplary embodiment of a circuit arrangement for current transformation.

According to FIG. 1, the circuit arrangement for current transformation contains four current branches with transistors T1 to T4, which are connected with one another in pairs at the emitter side. The control terminals of the transistors are connected in pairs in cross-coupled fashion. Of the transistors having a common control terminal, one is respectively connected as a diode. According to FIG. 1, the circuit arrangement thus has four current branches with a first transistor T1, a second transistor T2, a third transistor T3 and a fourth transistor T4. The transistors T1 and T4 are connected with one another at the emitter side, and the transistors T2 and T3 are connected with one another at the emitter side. The transistors T1 and T2 are connected with one another at the base side, and the transistors T3 and T4 are connected with one another at the base side. Each of the transistors T2 and T3 is connected as a diode by connecting its collector terminal with the base terminal.

A respective load element L1 to L4 is allocated to the output circuit of each transistor, which element can e.g. be designed as a resistor. The terminal of the load elements L1 to L4 that faces away from the allocated transistor is respectively connected with a supply potential V+.

In the emitter branches of the transistors coupled in pairs with one another, two current sources SQ1 for the transistors T1 and T4, as well as SQ2 for the transistors T2 and T3, are arranged. Output currents I1 to I4 are allocated to the transistors T1 to T4. In addition, the currents I2 and I3 have to produce the base-emitter currents for the transistors T1 and T2 on the one hand, as well as T3 and T4 on the other hand. The current sources SQ1 and SQ2 can be designed as a diode or as a transistor, fed by a predetermined supply potential. The current source SQ1 produces the current IO1, and the current source SQ2 produces the current IO2. The current sources SQ1 and SQ2 are connected with a second supply potential, preferably with the reference potential.

The system equations of the circuit arrangement according to FIG. 1 are:

$$I1/I4=I2/I3$$

$$I1+I4=IO1$$

$$I2+I3=IO2.$$

By means of transformation, one obtains therefrom e.g. the currents $$I1=I4\cdot I2/I3$$

and $$IO1=I4\cdot(1+I2/I3).$$

Of the six currents involved in the circuit arrangement, drawn in FIG. 1, three are independent. After the determination of three currents, the other three currents result from the system equations. This characteristic can be exploited to produce currents with dependencies that result during the transformation of the system equations. For example, it can be seen that the current I1 results from the multiplication of the currents I2 and I4 and division by the current I3. If I3 is selected as the nominated unit current, I1 then results from the multiplication of the currents I2 and I4. On the other hand, I1 results after the transformation of the system equations from the output current IO1 and the branch currents I2 and I3 to $$I1=IO1/(1+I3/I2).$$

The circuit arrangement according to FIG. 1 can, for example, be used for temperature compensation or to produce a current with a predetermined temperature coefficient. If for example the current I2 is derived from a constant voltage, and the current I3 is derived from a temperature-proportional voltage, and if in addition the current IO1 has a linear temperature transition of the form dIO1/dT=1+a·T, with a=const., then the current I1 is temperature-stable, i.e. independent of the absolute temperature T. I2 can for example be produced from a band-gap circuit and a resistor with an arbitrary temperature coefficient. I3 can be produced from a voltage proportional to the absolute temperature and a resistor with the temperature coefficient as used in the resistor for the production of I2. According to the formula for I1, the temperature coefficients for IO1 and I3 then compensate themselves, so that I1 is temperature-stable.

On the other hand, given the predetermination of I1 as temperature-stable, e.g. using a constant current source and the selection of I2 and I3 in the same way as explained above, namely I2 derived from a constant voltage and I3 derived from a temperature-proportional voltage, a current IO1 can, conversely, be produced that is proportional to the absolute temperature T. The advantage of the circuit arrangement is that a temperature-constant resistance, which cannot be produced in integrated technology, or can be so produced only with great difficulty, is not required. Only a resistance with a given temperature coefficient, which can however be given arbitrarily, is required.

Figure 2:
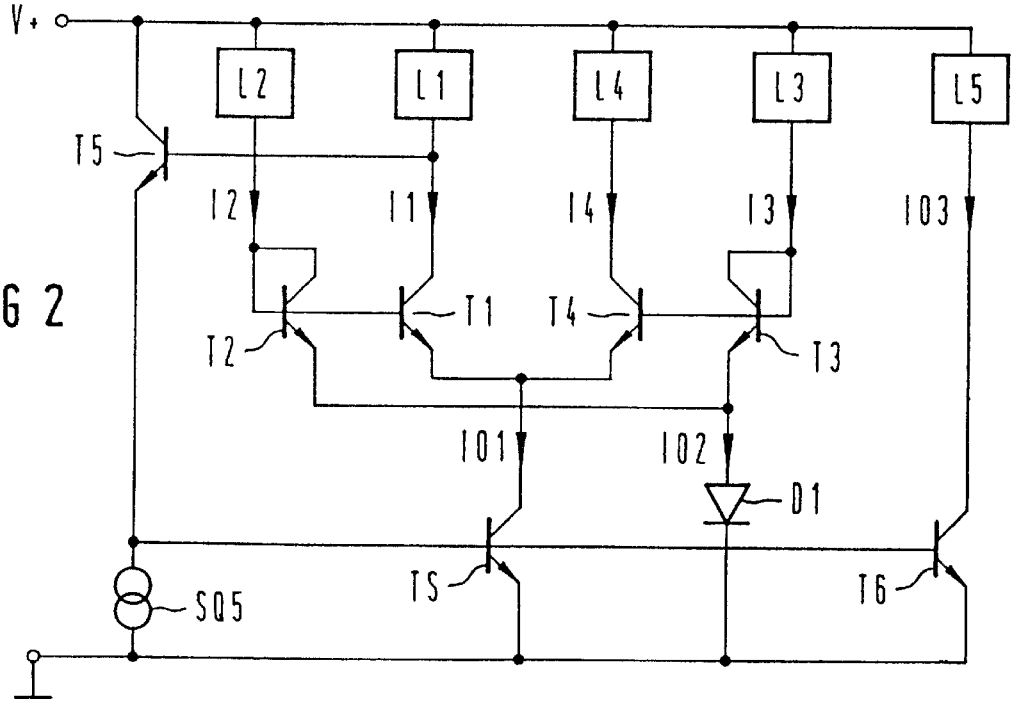
FIG. 2 shows a second exemplary embodiment of a current transformation circuit with two output currents.

According to FIG. 2, the circuit of FIG. 1 is expanded by a fifth current branch with the transistor T5 and a current source SQ5, connected in series between the supply voltage. T5 is controlled by the collector of the transistor T1. The control terminals of the current source transistor TS and of a sixth transistor T6 are controlled from the connection point of the transistor T5 with the current source SQ5. TS serves as a current source transistor for the transistors T1 and T4. The transistors T2 and T3 are fed by a source connected as a diode D1. The output current IO3 flows in the output circuit of the transistor T6. According to the system equations, the output currents $$I4=I1\cdot I3/I2$$

and $$IO3=I1\cdot(1=I3/I2)$$

result.

The circuit arrangement thus represents a combination of the individual possibilities resulting from the circuit of FIG. 1.

Of course, the circuit arrangements of FIGS. 1 and 2 can also be used for signal processing when the corresponding transformation functions are required.

Although various minor changes and modifications might be proposed by those skilled in the art, it will be understood that my wish is to include within the claims of the patent warranted hereon all such changes and modifications as reasonably come within my contribution to the art.

I claim as my invention:

1. A circuit arrangement for current transformation, comprising:

four current branches containing respective first, second, third, and fourth transistors coupled in pairs such that terminals of charge carrying sources of the first and the fourth transistors are connected with the first node point, and terminals of charge carrying sources of the second and the third transistors are connected with the second node point;

the control terminal and a terminal of a charge carrying drain of the second transistor being connected with one another, and a control terminal and a terminal of a charge carrying drain of the third transistors being connected with one another;

control terminals of the first and the second transistors being connected with one another, and control terminals of the third and fourth transistors being connected with one another; and a terminal of a charge carrying drain of the first transistor feeding a fifth current branch with a fifth transistor, one terminal of the fifth transistor at an output thereof being connected to control a sixth transistor in a sixth current branch.

2. The circuit arrangement according to claim 1 wherein the transistors are bipolar transistors, and the first and the second node points are emitter terminals connected in common.

3. The circuit arrangement according to claim 1 wherein the first and second node points are fed by respective current sources.

4. The circuit arrangement according to claim 3 wherein at least one of the current sources contains a diode.

5. The circuit arrangement according to claim 3 wherein at least one of the current sources contains a transistor controlled by a reference potential.

6. The circuit arrangement according to claim 1 wherein the output terminal of the fifth transistor also controls a transistor connected as a current source for the first and the fourth transistors.

7. The circuit arrangement according to claim 1 wherein one of the second and the third transistors is dependent on a constant voltage, and the other is dependent on a temperature proportional voltage, and wherein a current feeding the first and the fourth transistors has a predetermined temperature dependence.

8. Arrangement according to claim 1 wherein one of the second and third transistors is dependent on a constant voltage, and the other of the two transistors is dependent on a temperature proportional voltage, and one of currents through the first and the fourth transistors is temperature-stable.

9. A circuit arrangement for current transformation, comprising:

first, second, third, and fourth transistors each having their collectors connected to a respective load element, each of the load elements being connected to a voltage potential;

emitters of the first and fourth transistors being connected through a first current source to a reference potential, and emitters of the second and third transistors being connected to reference potential through a second current source;

a base and collector of the second transistor being connected together and a base and collector of the third transistor being connected together;

bases of the first and second transistors being connected together and bases of the third and fourth transistors being connected together;

a fifth transistor connected between the reference potential and the voltage potential via a third current source and wherein its base is connected to a collector of the first transistor;

a sixth transistor being connected in series with the load element between the reference potential and the voltage potential and having its base connected to said third current source;

a seventh transistor as said first current source having its base connected to said third current source; and said second current source comprising a diode.

10. The circuit arrangement according to claim 9 wherein the first current source comprises a transistor whose base is connected to a third current source.

11. The circuit arrangement according to claim 9 wherein the second current source comprises a diode.

* * * * *